US005167531A

United States Patent [19]

Broschard, III et al.

[11] Patent Number: 5,167,531

[45] Date of Patent: Dec. 1, 1992

[54] STACKED ELECTRICAL CONNECTOR WITH DIECAST HOUSING AND DRAWN SHELLS

[75] Inventors: John L. Broschard, III; Wayne S. Davis, both of Harrisburg, Pa.

[73] Assignee: AMP Incorporated, Harrisburg, Pa.

[21] Appl. No.: 853,565

[22] Filed: Mar. 18, 1992

[51] Int. Cl.[5] ..... H01R 13/658

[52] U.S. Cl. ..... 439/540; 439/607

[58] Field of Search ..... 439/108, 607, 608, 609, 439/540

[56] References Cited

U.S. PATENT DOCUMENTS

| | | | |
|---|---|---|---|
| 3,922,056 | 11/1975 | Murawski et al. | 439/607 |
| 4,601,527 | 7/1986 | Lemke | 439/608 |
| 4,684,197 | 10/1987 | Reichardt et al. | 439/404 |
| 4,789,357 | 12/1988 | Yamaguchi et al. | 439/607 |
| 4,806,109 | 2/1989 | Manabe et al. | 439/108 |
| 4,808,125 | 2/1989 | Waters et al. | 439/607 |
| 4,842,552 | 6/1989 | Frantz | 439/557 |
| 4,869,677 | 9/1989 | Johnson et al. | 439/108 |
| 4,889,502 | 12/1989 | Althouse et al. | 439/607 |
| 4,902,242 | 2/1990 | Davis et al. | 439/404 |
| 5,030,140 | 7/1991 | Sugiyama | 439/607 |
| 5,037,330 | 8/1991 | Fulponi et al. | 439/607 |
| 5,037,331 | 8/1991 | Goodman et al. | 439/607 |
| 5,044,984 | 9/1991 | Mosser et al. | 439/540 |
| 5,080,609 | 1/1992 | Fabian et al. | 439/540 |
| 5,085,590 | 2/1992 | Galloway | 439/95 |
| 5,104,329 | 4/1992 | Brown et al. | 439/609 |

*Primary Examiner*—Gary F. Paumen

[57] ABSTRACT

A rightangle board mount electrical connector of high contact density includes a diecast metal housing having a front wall and rearwardly projecting side walls. The front wall has upper and lower through openings therein each receiving a drawn metal shell which in turn receives an insulating header having cavities containing mating portions of electrical terminals. Each terminal has projecting obliquely and rearwardly from the respective header a terminal leg terminating in a soldering tail. The terminal legs are so dimensioned that the solder tails are arranged in four rows for insertion through holes in a spacer plate. A shield can be inserted downwardly between the housing side walls for retention in the housing. A downwardly inclined rearwall of the shield covers the terminal legs for complete shielding of the terminals. In use of the connector the housing is grounded to a circuit board in which the connector is mounted and the shield is similarly grounded.

25 Claims, 8 Drawing Sheets

STACKED ELECTRICAL CONNECTOR WITH DIECAST HOUSING AND DRAWN SHELLS

BACKGROUND OF THE INVENTION

This invention relates to a shielded, stacked, rightangle electrical connector for mounting on a circuit board for use, for example, in the computer field as an input-/output port.

There is disclosed in U.S. Pat. No. 4,808,125 a right angle, electrical connector comprising a diecast housing, for example, of zinc alloy, having a front wall formed with an opening receiving a drawn metal shell which in turn receives an insulating plastics insert having terminal receiving cavities with terminals secured therein. The terminals have mounting portions which are bent down at rightangles for insertion in holes in a printed circuit board. The mounting portions are unshielded at least from the top and from the rear. U.S. Pat. No. 5,085,590 discloses a stacked electrical connector assembly for mounting on a printed circuit board. Superposed electrical connectors are mounted to vertically extending members of a metal bracket. A shield member extends at least partially between the connectors. There is disclosed in U.S. Pat. No. 5,080,609, a stacked electrical connector assembly for surface mounting on a printed circuit board, comprising a sheet metal supporting bracket having upper and lower connector mounting lugs upon which respective upper and lower electrical connectors are mounted. Boardlocks are passed through holes in the lower mounting lugs to secure the bracket to a circuit board. The lower connector has terminals with mounting portions bent down at right angles for insertion in holes in the circuit board, terminals of the upper connector being connected to traces on the circuit board by way of a flat flexible cable. As disclosed in U.S. Pat. No. 5,044,984, two shielded electrical connectors are stacked in superposed relationship on spaced metal brackets, one at either end of the connectors. The brackets are secured to a circuit board by means of boardlocks passed through holes in bottom flanges of the brackets. Terminals of the connectors have mounting portions which are bent down at rightangles for insertion through holes in the circuit board. U.S. Pat. No. 5,037,330 discloses a shielded, stacked connector assembly for surface mounting on a circuit board. Two electrical connectors are stacked in superposition in a rectangular metal shield, on an insulating connector support housing, the shield being rearwardly open. The connectors have terminals with mounting portions bent down at rightangles for insertion in holes in the circuit board. Lower edges of the shield have mounting feet soldered to ground conductors on the board.

SUMMARY OF THE INVENTION

The present invention provides a stacked, rightangle electrical connector for mounting on a circuit board, in which the contact density is maximized and at the same time the connector is fully shielded by means of a diecast metal housing, drawn metal shells and a metal shield enclosing the connector from the rear.

According to one aspect of the present invention, a rightangle electrical connector for mounting on a circuit board comprises a diecast metal housing having a front wall formed with upper and lower through openings. Side walls project from opposite lateral ends of the front wall rearwardly thereof, board engaging bottom walls extending towards each other from inner faces of the side walls. Projections depend from the bottom walls for electrically connecting the diecast metal housing to ground by way of the circuit board. A first drawn metal shell defining a through aperture is secured in the upper through opening of the metal housing and a second drawn metal shell is secured in the lower through opening of the metal housing. A first insulating header is received in the aperture of the first drawn shell and a second insulating header is received in the aperture of the second drawn shell. Each header has a mating face exposed in the forward direction of the housing front wall and a terminal receiving face directed rearwardly of the housing front wall. The first header comprises a first group of electrical terminals, the second header comprising a second group of electrical terminals. Each terminal has a mating portion within the header which is exposed towards the mating face of the header, a terminal leg projecting obliquely downwardly and rearwardly beyond the terminal receiving face of the header and between the housing side walls and a soldering tail projecting downwardly below the bottom walls of the housing. The solder tails of the terminals of each group of terminals are arranged in at least one row, all of said rows being parallel.

DESCRIPTION OF THE PREFERRED EMBODIMENT

Figure 1:
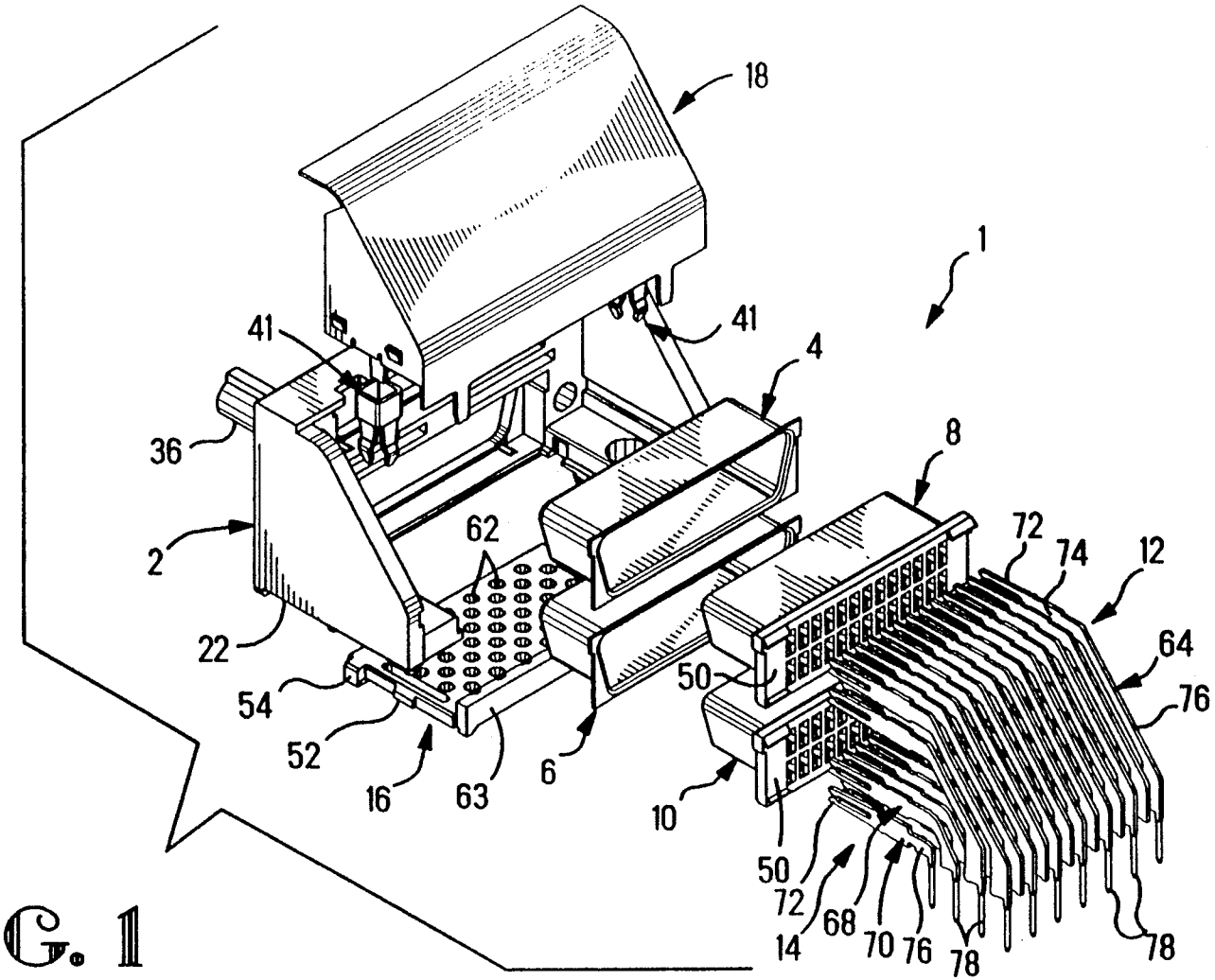
FIG. 1 is an exploded isometric view of a stacked, right angle electrical connector showing a preferred embodiment of a metal shield thereof.
Figure 2:
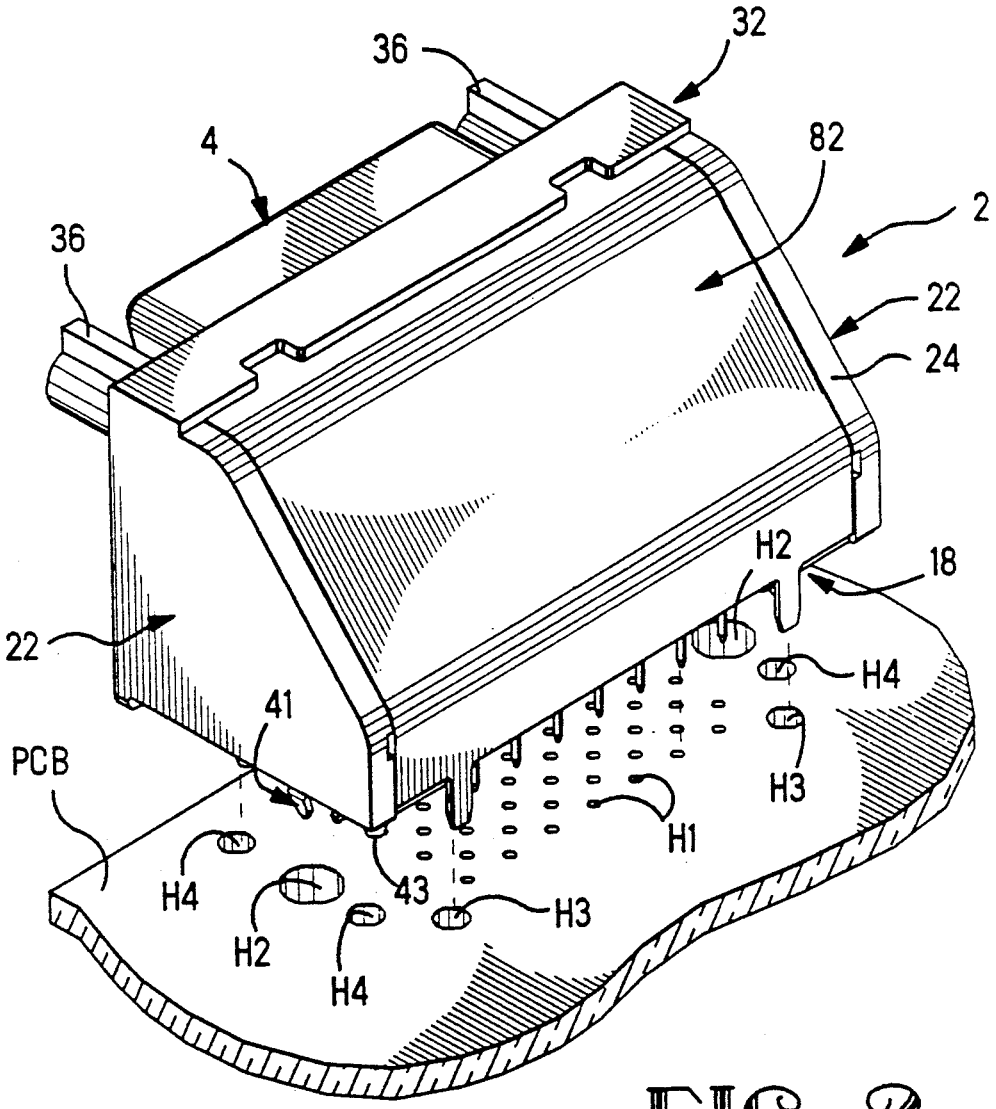
FIG. 2 is a rear isometric view of the connector in its assembled state, exploded from a circuit board.

A shielded, stacked, right angle, electrical connector 1, for mounting on a circuit board PCB, is shown in the exploded perspective view of FIG. 1. The connector, which may be used in the computer field as an input-/output port, comprises a die cast metal housing 2, receiving upper and lower drawn metal shells 4 and 6 respectively, the shells 4 and 6 receiving insulating upper and lower header inserts 8 and 10, respectively, the inserts 8 and 10, in turn receiving upper and lower groups 12 and 14, respectively of an array of electrical terminals. The connector 1 further comprises a terminal tail spacer plate 16 and a metal shield 18 covering the rear of the housing 2. The connector 1 will now be described with reference to FIGS. 1 to 11.

Figure 3:
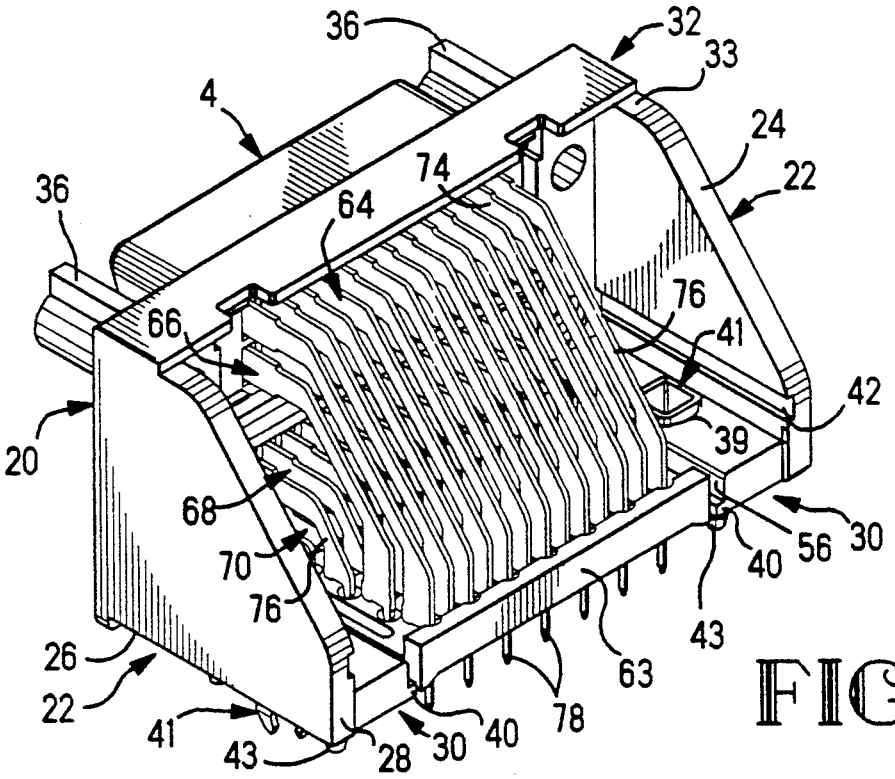
FIG. 3 is a rear isometric view of the connector of FIG. 2, with the shield removed.
Figure 4:
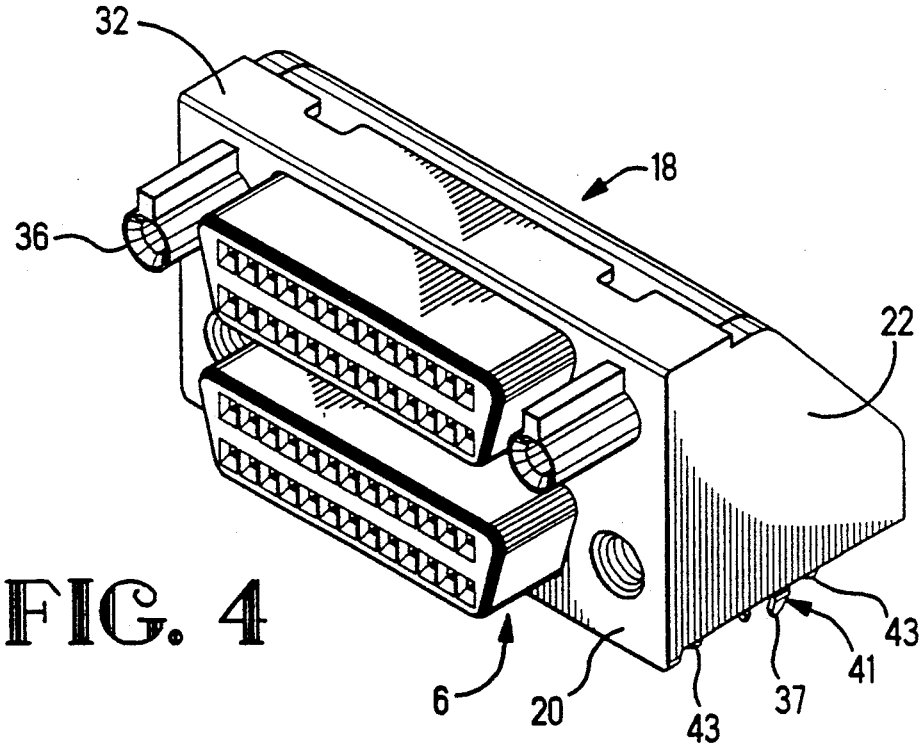
FIG. 4 is a front isometric view of the connector of FIG. 2.
Figure 5:
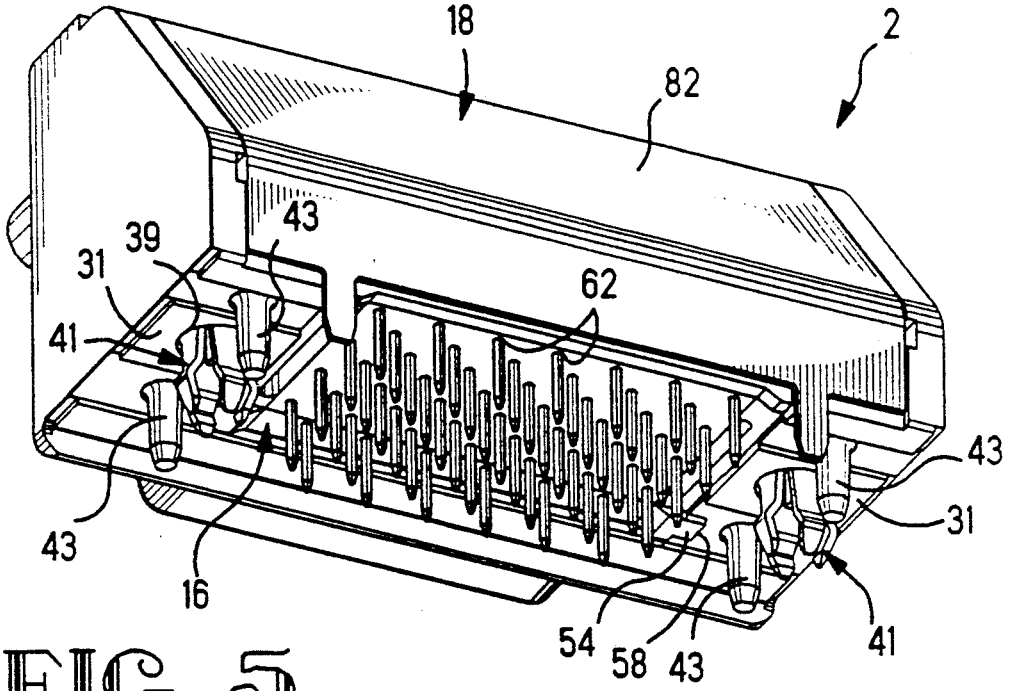
FIG. 5 is a bottom isometric view of the connector of FIG. 2.
Figure 6:
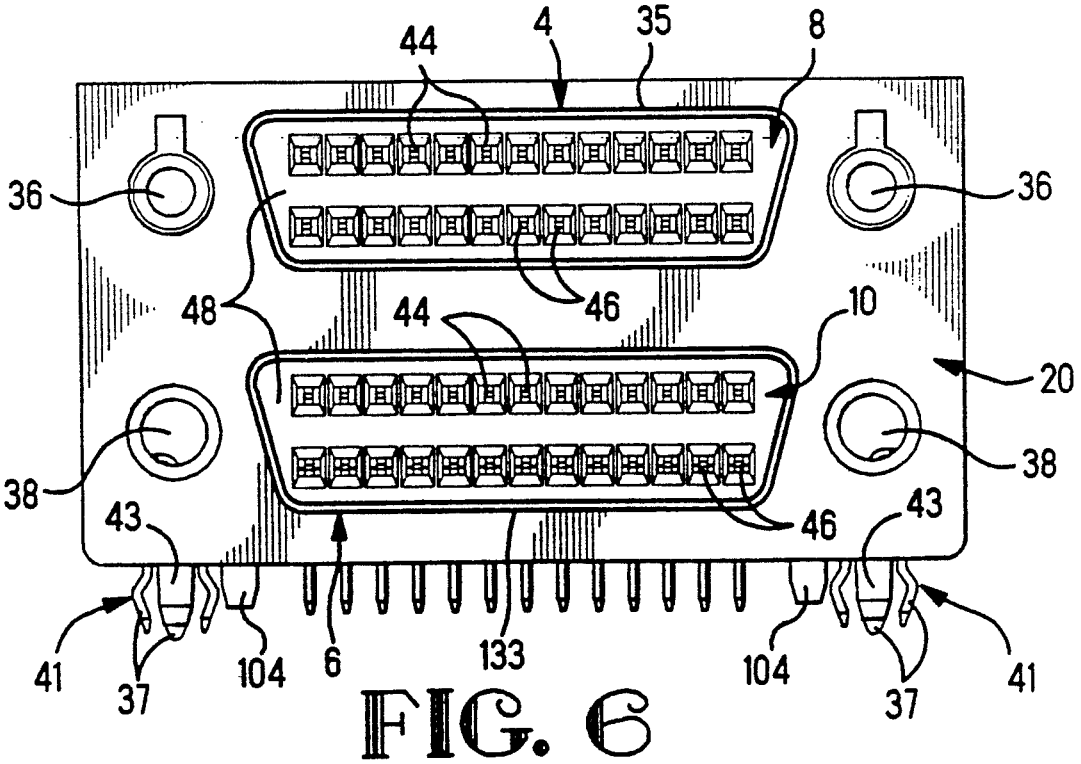
FIG. 6 is a front elevational view of the connector of FIG. 2.
Figure 10:
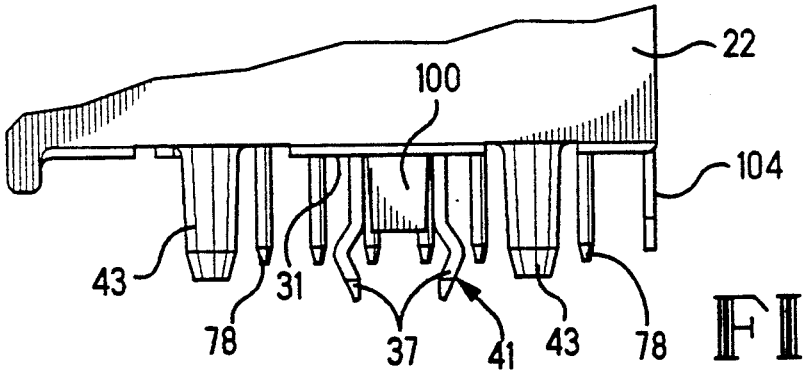
FIG. 10 is a fragmentary side view illustrating details of the connector of FIG. 2.
Figure 11:
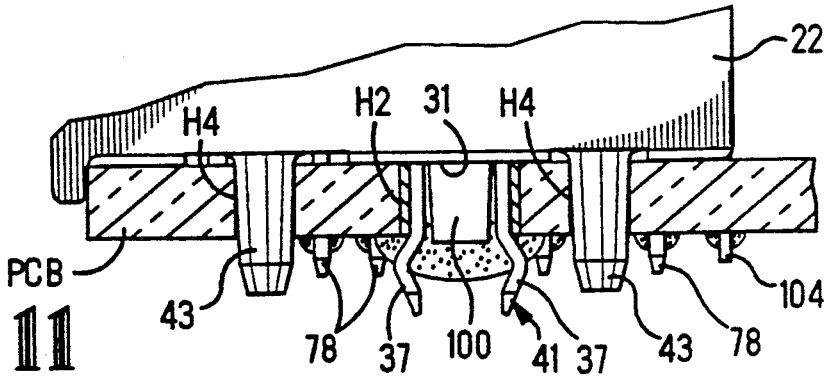
FIG. 11 is a fragmentary side view shown partly in section illustrating details of the connector of FIG. 2, when it has been mounted to the circuit board.

The die cast housing 2 comprises a front wall 20 and opposite side walls 22 tapering rearwardly from opposite ends of the front wall 20, each side wall 22 having a downwardly inclined upper edges 24, a horizontal bottom edge 26 extending at right angles to the front wall 20 and a vertical rear edge 28 joining the edges 24 and 26, parallel with the wall 20. The housing 2 is best seen in FIGS. 3 and 6. The housing 2 has a pair of board engaging members in the form of opposed, rudimentary, bottom walls 30 projecting inwardly of the housing 2, from the side walls 22, proximate to their bottom edges 26. Each wall 30 has a board engaging bottom face 31 (FIGS. 5, 10 and 11). The housing 2 also has a rudimentary forward top wall 32 extending rearwardly from the upper end of the front wall 20 and spanning the side walls 22. Each edge 24 is joined to the top wall 32 at a short, horizontal top edge 33.

The front wall 20 is formed with a pair of spaced keys 36 cast therein or threadably securable thereto with key 36 being representative of both versions, near its upper end, each key 36 being located proximate to a respective side wall 22. Below each key 36 the front wall 20 is formed with threaded screwlocks 38. The keys 36 and the screwlocks 38 are provided for cooperation with complimentary keyways and jack screws, respectively, of an electrical connector (not shown) for mating with the connector 1.

Keys 36 may have a threaded shank receivable in a threaded aperture in front wall 20 or may be cast into housing 2. Keys 36 project forwardly of wall 20 and have a keying rib 37 thereon. Typically the keys are provided in pairs with the rib 37 on each key 36 oriented in the coordinated directions. The rib 37 may take on other angular positions. Typical positions are at equal angular orientations such as vertically as shown, both laterally outwardly—the rib on the left key to the left and the rib on the right key to the right—and both vertically downward. The central bore of the key may be threaded to receive a jackscrew. The same structure as key 36, without rib 37, forms a screwlock.

As shown in FIG. 6 between the keys 36, the front wall 20 is formed with an upper, laterally elongate, through opening 35, and between the keyways 38, with a lower, lateral, elongate through opening 133, as shown in FIG. 6. Each bottom wall 30 is formed with an inwardly projecting lower step 40 extending the full length thereof and has a central through bore 39 extending through the board engaging face 31 of the wall 30, in which is secured a hollow board lock 41, in the manner described in, and being constructed according to, the teaching, U.S. Pat. No. 4,842,552 which is hereby incorporated herein by reference. Each board lock 41 comprises an annular strap supported in the respective bore 39 and from which strap depend below the face 31 four locking legs 37. There depends from each bottom wall 30 of the housing 2, on each side of each board lock 41 therein, a board mounting protrusion 43. The inner face of each side wall 22 is formed, just above the respective bottom wall 30, with a longitudinal latching groove 42 extending the full length of the side wall 22.

The drawn shells 4 and 6, which are constructed according to the teaching of U.S. Pat. No. 4,808,125 which is hereby incorporated herein by reference, are secured in the openings 35 and 133 respectively, according to the teaching of that U.S. Patent. In this manner, both shells 4 and 6 are electrically commoned with housing 2. A shielded mating connector engaging either shell 4 or 6 is grounded to a circuit board on which connector 1 is mounted through housing 2 and boardlock 41 to a ground trace on the circuit board. The headers 8 and 10 are secured in the shells 4 and 6, respectively, also in the manner taught by U.S. Pat. No. 4,808,125. Each header 8 and 10 has an upper row of terminal receiving, through cavities 44 and a lower row of terminal receiving, through cavities 46. Each cavity 44 and 46 opens into a front mating face 48, and a rear terminal receiving face 50, of the respective header 8 and 10.

The terminal tail spacer plate 16 is constructed according to the teaching of U.S. patent application Ser. No. 757,086 filed on Sep. 10, 1991 and which is hereby incorporated herein by reference. The plate 16 rests upon the steps 40 of the bottom walls 30 and has lugs 52 and 54 at each end of the plate 16, which engage in complimentary recesses of the inner faces 56 of the walls 30. The plate 16 has a rear 63, extending the full length thereof. There are provided in the plate 16, a plurality of longitudinally extending rows of terminal tail receiving through holes 62.

The group 12 of terminals comprises an upper row of first terminals 64 and a lower row of second terminals 66, the group 14 of terminals comprising an upper row of third terminals 68 and a lower row of fourth terminals 70. Each terminal 64, 66, 68, 70 is uniplanar and comprises a forked, forward mating portion 72, a retention portion 74 extending rearwardly therefrom, the portions 72 and 74 being rectilinear and being longitudinally aligned with each other, a rectilinear leg 76 extending rearwardly from the portion 74 and being downwardly angled with respect thereto, and terminating in a solder tail 78 depending from the bottom of the leg 76 at right angles to the portions 72 and 74. The mating portions 72 of the terminals 64 are received in respective cavities 44 of the upper row of cavities of the header 8, the mating portions 72 of the terminals 66, being received the cavities 44 of the lower row of cavities 46 of the header 8. The mating portions 72 of the terminals 68 are received in respective cavities 44 of the upper row of cavities of the header 10, the mating portions 72 of the terminals 70 being received in the cavities 46 of the lower row of cavities of the header 10. The retention portions 74 of the terminals, each of which portions is transversely enlarged, in its own plane, serve to retain the terminals in the cavities, with the forked mating portions 72 of the terminals projecting towards the respective mating faces 48. The legs 76 of the terminals 64 are longer than those of the terminals 66, the legs 76 of the terminals 66 being longer than those of the terminals 68 and the legs 76 of the terminals 68 being longer than the legs 76 of the terminals 70. The downward angle of the legs 76 of the terminals 64 may be less than that of the legs 76 of the terminals 76, the angle of the legs 76 of the terminals 66 being less than that of the terminals 68 and the angle of the legs 76 of the terminals 68 being less than that of the legs of the terminals 70.

By virtue of these configurations of the legs 76, the solder tails 78 of the terminals 64 extend through the holes of the rearmost row of holes 62 in the plate 16, the tails 78 of the terminals 66 extending through the holes of the next rearmost row of holes 62, the tails 78 of the terminals 68 extending through the holes of next row of holes 62 in the forward direction and the tails 78 of the terminals 70 extending through the holes of the foremost row of holes 62 in the plate 16. The spacer plate 16 is pressed over the tails 78 according to the teaching of the Patent Application mentioned above.

Figure 7:
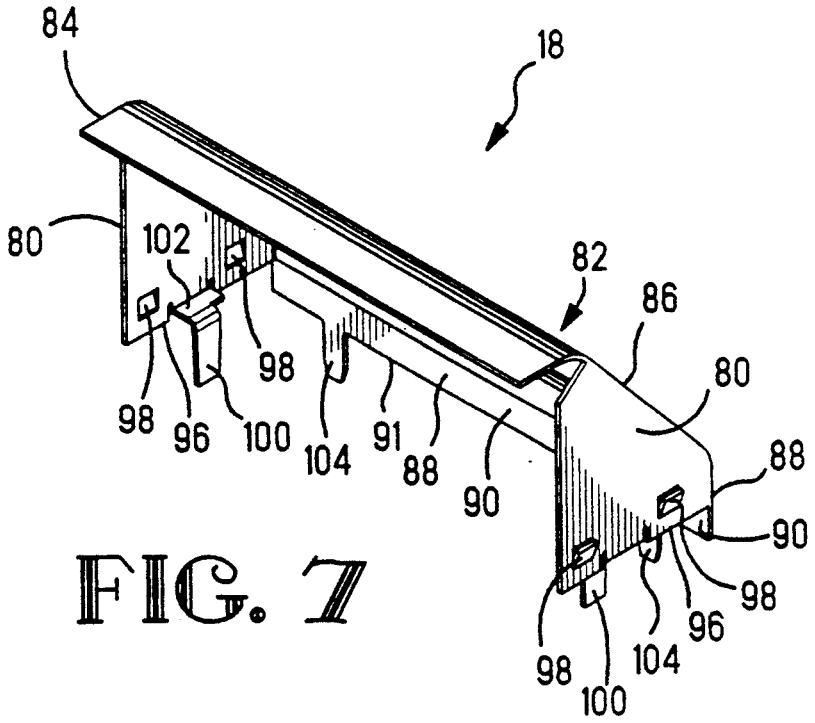
FIG. 7 is an isometric view of the metal shield of the connector of FIG. 2.
Figure 8:
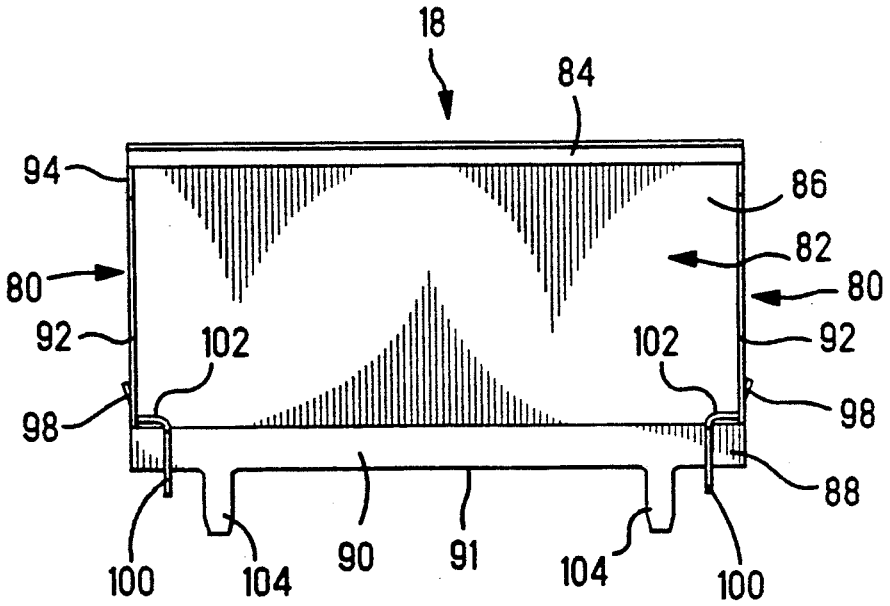
FIG. 8 is a front elevational view of the shield of FIG. 7 showing the interior thereof.
Figure 9:
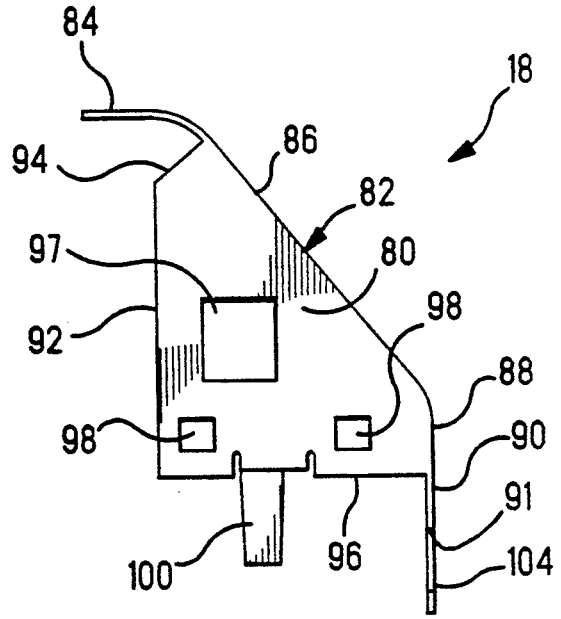
FIG. 9 is an end view of the shield of FIGS. 7 and 8.

As best seen in FIGS. 7 to 9, shield 18, which has been stamped and formed from a single piece of sheet metal stock, comprises opposite side walls 80 of substantially triangular shape, a rear wall generally referenced 82 and a top wall in the form of a forwardly projecting cantilever flap 84 which is free of the walls 80, the shield 18 being open forwardly. The rear wall 82 comprises a rearwardly, and downwardly, inclined upper forward portion 86, a lower rear portion 88, and a lowermost rear portion 90 depending below the side walls 80 and having a bottom edge 91. The side walls 80 are connected only by the wall portions 86 and 88. The side walls 80 have vertical forward edges 92, surmounted by forwardly and downwardly inclined edge portions 94 configured to allow resilient flexure of the flap 84 as will best be apparent from FIG. 9. Each sidewall 80 may have a lateral positioning window 97 (shown in FIGS. 9, 13 and 14) to prevent lateral movement of shield 18 in housing 2 prior to soldering. The window engages the inner surface of sidewalls 22 to prevent the lateral motion, and concomitantly provide additional points of electrical continuity therebetween.

The side walls 80 have bottom edges 96. Each side wall 80 has, proximate to its bottom edge 96, a pair of struck out, outwardly and upwardly inclined, latching tongues 98. Between its tongues 98, each side wall 80 has a central, flat, grounding tab 100, connected to the edge 96 of the wall 80 by a horizontal strap 102 normally thereof. Each tab 100 is thereby offset inwardly of the respective wall 80 in parallel relationship therewith. There may depend from the bottom edge 91 of the wall portion 88 pair of further flat grounding tabs 104, which are coplanar therewith and the planes of which extend at right angles with those of the tabs 100. The free ends of the tabs 104 may lie below those of the tabs 100.

In order to mount the shield 18, to the partially completed connector shown in FIG. 3, the shield 18 is moved down vertically with its tabs 100 and 104 leading, into the die-cast metal housing 2, so that the latching tongues 98 on each side wall 80 of the shield 18 are initially pressed inwardly and then resile outwardly to latch into respective grooves 42 in the side walls 22 of the housing 2. Windows 97, if present, are pressed inwardly but biasingly engage the inner surface of walls 22. The flap 84 of the shield 18 is simultaneously resiliently depressed and inserted under the top wall 32 of the housing 2. In this manner, the rear wall portions 86 and 88 of the shield 18 cover the rear edges of the terminals of the groups 12 and 14 but are spaced therefrom, the lowermost rear wall portion 90 of the shield 18 abutting in face-to-face relationship against the rear wall 63 of the spacer plate 16 and the tabs 104 projecting therebelow and therebehind. In this assembled position of the shield 18, each tab 100 thereof projects through the annular strap of a respective one of the board locks 41, and extends between the locking legs 37 thereof, as best seen in FIG. 10. The resilient engagement of the flap 84 against the top wall 32 urges the bottom edge 96 of the shield 18 down against the bottom walls 30. The complete connector 1 is shown in FIGS. 2, and 4 to 6.

The circuit board PCB (FIG. 2) upon which the assembly 1 is to be surface mounted, has provided therein an array of smaller, plated through holes H1 for receiving the terminal tails 78, two larger, plated through holes H2 for receiving the board locks 41, two further, plated through holes H3 for receiving the tabs 104, four further through, unplated holes H4 for receiving the mounting protrusions 43 of the housing 2.

When the connector 1 has been mounted to the board PCB with the terminal tails 78, the board locks 41, the tabs 104 and the mounting protrusions 43 projecting through the holes provided for them in the board PCB, as shown in FIG. 11, the parts projecting below the board PCB, of the terminal tails 78, are soldered to respective signal conductors (not shown) on the board PCB, the locking legs 37 of the board locks 41, and the tabs 104 being soldered to ground conductors (not shown) on the board PCB. Since the tabs 100 extend into the board locks 41, they are likewise soldered to the grounding conductors to which the legs 37 are soldered, as shown in FIG. 11. No additional plated through holes in the board PCB have, therefore, to be provided for the tabs 100. The drilling program for the board is thereby simplified and lining metal is saved.

When shield 18 has as many tabs 100 (or 104) as the connector has boardlocks, there are no additional through holes required solely to accommodate additional shield grounding tabs. When shield 18 has more tabs 100 (or 104) than boardlocks, the number of through holes required can be minimized by having at least some of the through holes perform a dual function of providing a boardlocking function, and possibly concomitantly grounding through the boardlock, as well as providing a path to ground for a ground tab on shield 18.

Further, the board locks 41 serve to protect the tabs 100 from stubbing against the board PCB when the connector 1 is being mounted thereto, or being otherwise damaged when the connector 1 is being handled.

Figure 12:
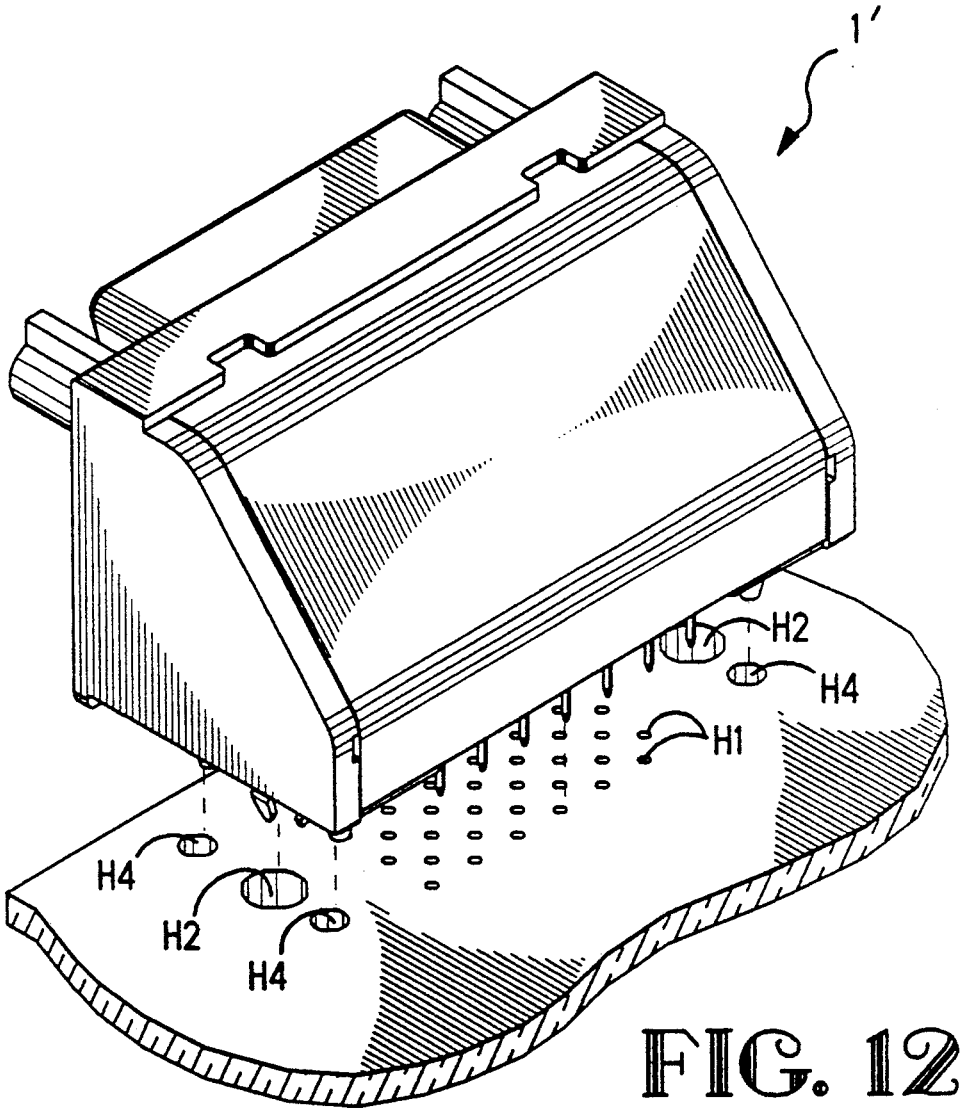
FIG. 12 is a similar view to that of FIG. 2, but illustrating a modification of the metal shield.

The connector 1' shown in FIG. 12 is the same as connector 1 described above, excepting that the tabs 104 of the shield are not provided. The provision of the holes H3 in the circuit board is accordingly avoided.

Figure 13:
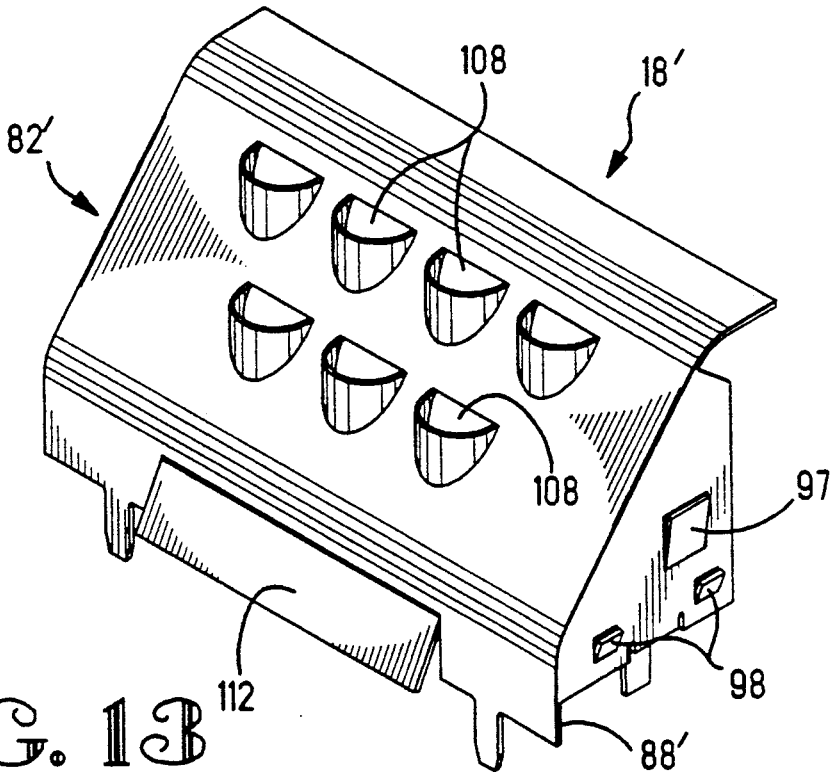
FIG. 13 is a rear isometric view illustrating further modifications of the metal shield.
Figure 14:
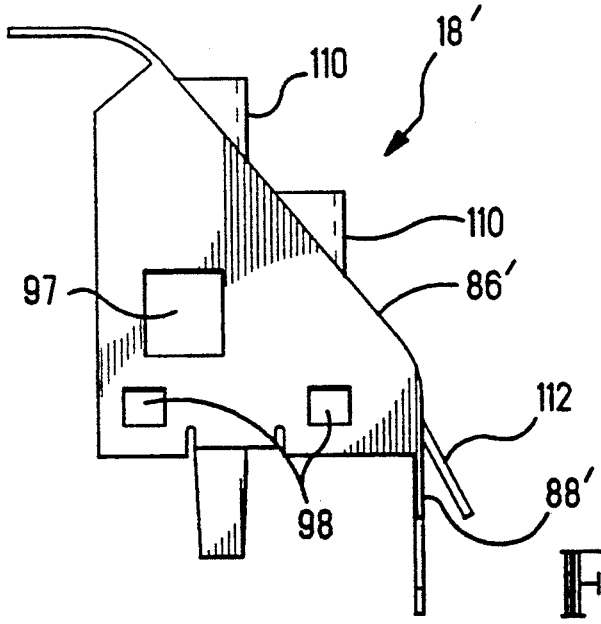
FIG. 14 is an end view of the shield of FIG. 13.

As shown in FIGS. 13 and 14, a shield 18' according to an alternative embodiment, is the same as the shield 18, excepting that the wall portion 86' of the rear wall 82' is formed with rows of holes 108 provided with struck out, semi-circular funnels 110 extending thereabout for the introduction of cleaning fluids, which may be liquids or gases, to flush out debris from beneath the terminal tail spacer plate. The liquids may flush out debris that might otherwise short between solder tails; air may be used to dry. This may be achieved with shield 18' in place. The wall portion 88' is provided with a rearwardly inclined flap 112 to allow for the egress of the said fluids.

What is claimed is:

1. A rightangle electrical connector for mounting on a circuit board, said connector comprising:

a diecast metal housing having a front wall formed with upper and lower through openings, side walls projecting from opposite lateral ends of the front wall rearwardly thereof, board engaging bottom walls extending towards each other from inner faces of the side walls, and projections depending from said bottom walls for electrically connecting said housing to ground by way of the circuit board;

a first drawn metal shell defining a through aperture and being secured in said upper through opening and a second drawn metal shell defining a through aperture and being secured in said lower through opening;

a first insulating header received in the aperture of said first drawn shell and a second insulating header received in the aperture of said second drawn shell, each header having a mating face exposed in the forward direction of the front wall of the housing and a terminal receiving face directed rearwardly of said front wall;

a first group of electrical terminals in the first header and a second group of electrical terminals in the second header, each terminal having a mating portion within the header and being exposed towards the mating face thereof, a terminal leg projecting obliquely downwardly and rearwardly beyond the terminal receiving face of the header and between the housing side walls, and a soldering tail projecting downwardly below said bottom walls, the solder tails of each group of terminals being arranged in at least one row, all of said rows being parallel to each other; and a metal shield having side walls secured between the side walls of the housing and a downwardly and rearwardly inclined rear wall covering said terminal legs and being spaced therefrom.

2. A connector as claimed in claim 1, wherein the first group of terminals comprises an upper row of first terminals and a lower row of second terminals, the second group of terminals comprising an upper row of third terminals and a lower row of fourth terminals, the legs of the first terminals being longer than those of the second terminals, the legs of the second terminal being longer than those of the third terminals, and the legs of the third terminals being longer than those of the fourth terminals, the angle of inclination of legs of the first terminals being less than that of the legs of the second terminals, the angle of inclination of the legs of the second terminals being less than that of the legs of third terminals and the angle of inclination of the legs of the third terminals being less than that of the legs of the fourth terminals.

3. A connector as claimed in claim 1, wherein each terminal is uniplanar, each group of terminals comprising superposed rows of terminals, the planes of the terminals of each row being parallel to each other and each terminal of each row being coplanar with a terminals of each of the other rows.

4. A connector as claimed in claim 1, wherein the diecast metal housing has a top wall spanning the housing side walls, the rear wall of the shield having a resilient flap projecting forwardly and being engaged beneath the housing top wall and thereby urging bottom edges of the shield side walls against the bottom walls of the housing.

5. A connector as claimed in claim 4, wherein each shield side wall has an obliquely upwardly and outwardly projecting latching tongue, each of the housing side walls having a latching opening receiving the latching tongue of the proximate shield side wall.

6. A connector as claimed in claim 1, wherein a soldering tail spacer plate secured between the housing bottom walls is formed with a row of through holes each receiving a respective one of the soldering tails of the terminals, the spacer plate having a rear wall, the rear wall of the shield having a vertical lower wall portion engaging the rear wall of the spacer plate.

7. A connector as claimed in claim 6, wherein each bottom wall of the diecast housing has an inwardly and laterally projecting ledge upon which the spacer plate rests, end projections on the spacer plate engaging in recesses in the bottom walls of the housing.

8. A rightangle electrical connector for mounting to a circuit board, said connector comprising:

upper and lower insulating headers each having a forward mating face and a rearward terminal receiving face and defining a plurality of terminal receiving cavities each opening into both of said faces;

first and second groups of electrical terminals each having a mating portion secured in an individual one of said cavities and being exposed proximate to the mating face of the header and a terminal leg extending rearwardly from the terminal receiving face of the header and terminating in a soldering tail positioned for insertion through a respective hole in the circuit board;

a diecast metal housing supporting said headers in superposed relationship and having side walls laterally enclosing said terminal legs;

first and second annular metal shields each surrounding a respective one of said headers and being electrically connected to said housing;

a third metal shield resiliently insertable from above, between the housing side walls so as to be latched to said housing and so as to enclose said terminal legs from the rear; and projections depending from said third shield and said housing for connection to ground by way of said circuit board.

9. A connector as claimed in claim 8, wherein said third shield has a cantilever top wall, said housing having a rudimentary top wall, and a bottom wall, the top wall of the third shield being insertable under the top wall of the housing to urge side walls of the third shield down against the bottom wall of the housing.

10. A connector as claimed in claim 8, wherein each terminal is uniplanar, the plane of each terminal being parallel to the housing side walls, the terminals being arranged in superposed rows and each terminal being coplanar with a terminal of each row.

11. A connector as claimed in claim 8, wherein the housing has rudimentary bottom walls projecting towards each other from the housing side walls, the projections of the housing and the projections of the third shield depending from said bottom walls.

12. A connector as claimed in claim 8, wherein the third shield has side walls and an inclined rear wall covering said terminal legs, each housing side wall having formed therein a recess, each shield side wall having a struck out latching tongue which is upwardly inclined for latching engagement in a respective one of said recesses.

13. A diecast metal housing for a surface mounted rightangle electrical connector, the housing comprising a front wall having opposite ends, superposed, parallel, elongate, through, upper and lower header receiving openings formed in said front wall, a side wall projecting rearwardly, from each end of the front wall and having a bottom edge, a rudimentary bottom wall projecting from an inner face of each side wall, said bottom walls facing each other and extending rearwardly from said front wall up to rear ends of said side walls, facing surfaces of said bottom walls being spaced from each other substantially by the length of said header receiving openings, and a rudimentary top wall connected to said front wall and extending rearwardly thereof.

14. A housing as claimed in claim 13, wherein each bottom wall has a bottom face and top face and a through bore opening into both of said faces.

15. A housing as claimed in claim 13, wherein the rudimentary top wall bridges upper horizontal edges of said side walls from which extend downwardly inclined rearward edges of the side walls, a vertical rear edge extending downwardly from the end of each inclined edge remote from the respective upper edge.

16. A housing as claimed in claim 13, wherein facing surfaces of said side walls are each formed with a groove extending from said front wall at rightangles thereto and opening into the rear end of the side wall.

17. A housing as claimed in claim 13, wherein the facing surfaces of the bottom walls are each formed with a step extending from said front wall and opening into the rear end of said bottom wall.

18. A stacked electrical connector for mounting on a circuit board having a ground, the connector comprising:

an electrically conductive die cast housing, said die cast housing having first and second apertures receiving first and second electrically conductive drawn shells, said drawn shells being electrically commoned with the die cast housing, said drawn shells each having a cavity therein;

at least one insulating housing received in at least one of the cavities, said at least one insulating housing having contacts secured therein, said contacts having a mating portion extending into the housing, whereby the die cast housing provides an electrical path from the first and second shells to a ground on the circuit board.

19. An electrical connector as recited in claim 18, wherein the first and second apertures are vertically aligned.

20. An electrical connector as recited in claim 18, wherein the die cast housing further comprises a board engaging surface having a boardlock receiving recess therein, the boardlock receiving recess having an electrically conductive boardlock secured therein, whereby the electrical path from the first and second shells to the circuit board includes the boardlock.

21. An electrical connector as recited in claim 18, wherein the drawn shells are received in respective ones of the first and second apertures.

22. An electrical connector as recited in claim 21, wherein at least one of the first and second shells are received in the respective aperture in an interference fit.

23. An electrical connector as recited in claim 18, further comprising keys secured to the die cast housing.

24. An electrical connector as recited in claim 18, wherein the keys are threadably securable to the die cast housing.

25. An electrical connector as recited in claim 18, further comprising screwlocks threadingly securable to the die cast housing.

* * * * *